US005129998A

United States Patent [19]

Tabereaux et al.

[11] Patent Number: 5,129,998

[45] Date of Patent: Jul. 14, 1992

[54] REFRACTORY HARD METAL SHAPES FOR ALUMINUM PRODUCTION

[75] Inventors: Alton T. Tabereaux, Colbert County; Douglas V. Stewart; Nolan E. Richards, both of Lauderdale County, all of Ala.

[73] Assignee: Reynolds Metals Company, Richmond, Va.

[21] Appl. No.: 703,312

[22] Filed: May 20, 1991

[51] Int. Cl.[5] ..... C25C 3/06; C25C 3/08

[52] U.S. Cl. ..... 204/67; 204/243 R; 204/245; 204/288; 204/294; 266/287

[58] Field of Search ..... 206/67, 243 R-247, 206/286-289, 294; 75/709, 900, 901, 686; 266/287

[56] References Cited

U.S. PATENT DOCUMENTS

| | | | |
|---|---|---|---|
| 1,750,751 | 3/1930 | Geyer . | |
| 2,695,919 | 10/1972 | Brondyke | 117/52 |
| 3,633,666 | 1/1972 | Sparks | 165/185 |
| 3,729,097 | 4/1973 | Collins et al. | 210/69 |
| 4,014,704 | 3/1977 | Miller | 106/38.22 |
| 4,043,823 | 8/1977 | Washburn et al. | 106/40 R |
| 4,097,292 | 1/1978 | Huseby et al. | 106/38.9 |
| 4,106,905 | 8/1978 | Schmitt et al. | 21/60.5 R |
| 4,113,241 | 9/1978 | Dore | 266/227 |
| 4,119,469 | 10/1978 | Carbonnel et al. | 106/40 R |
| 4,139,934 | 2/1979 | Bayard | 164/411 X |
| 4,156,614 | 5/1979 | Greskovich et al. | 106/38.9 |
| 4,258,099 | 3/1981 | Narumiya | 428/311 |
| 4,376,690 | 3/1983 | Kugler | 204/288 X |
| 4,436,598 | 3/1984 | Tabcreaux et al. | 204/67 |
| 4,532,017 | 7/1985 | Keinborg et al. | 204/67 |
| 4,533,452 | 8/1985 | Leroy et al. | 204/243 R |
| 4,568,430 | 2/1986 | Viré | 204/67 |
| 4,595,475 | 6/1986 | Pawlek et al. | 204/243 R |
| 4,600,560 | 7/1986 | Vallak | 422/41 |
| 4,622,111 | 11/1986 | Brown et al. | 204/243 R X |
| 4,631,121 | 12/1986 | Stewart et al. | 204/288 X |
| 4,919,782 | 4/1990 | Stewart | 204/243 R X |

*Primary Examiner*—Donald R. Valentine
*Attorney, Agent, or Firm*—Alan T. McDonald

[57] ABSTRACT

The density of various refractory hard metal articles are controlled so that articles made from the refractory hard metals are able to float on the surface of molten aluminum. Floating such articles on aluminum has been found to both stabilize and protect the surface of molten aluminum. Floating cathodes for use in aluminum reduction cells is a particular application for the floating refractory hard metals.

13 Claims, 3 Drawing Sheets

REFRACTORY HARD METAL SHAPES FOR ALUMINUM PRODUCTION

TECHNICAL FIELD

The present invention relates to various refractory hard metals and ceramic materials and articles made therefrom which are floatable in molten aluminum. More particularly, the present invention relates to various protective structures and cathode elements which float on molten aluminum and aluminum alloys.

BACKGROUND ART

A number of structures have been developed which are designed to float, for various purposes, on molten metals and alloys. For example, U.S. Pat. No. 3,633,666 to Sparks discloses a floating heat conductor on a molten metal in a metal furnace. The floating heat conductor of Sparks is made from silicon carbide.

U.S. Pat. No. 3,729,097 to Collins et al and U.S. Pat. No. 4,113,241 to Dore each disclose filter devices which are designed to be floated in a pool of molten metal. The filters of Collins et al and Dore are made from dense graphite.

U.S. Pat. No. 4,106,905 to Schmitt et al discloses floating a layer of hollow discrete particles on a molten bath. The layer of hollow particles provide an insulating cover. The hollow particles are made from various materials listed at column 3 of Schmitt et al.

The above patents represent some of the more common floating articles which are utilized in conjunction with molten materials. In addition to the above devices which provide for insulation, heat conduction, and support of filtering devices, a few floating structures have been specially developed more recently for use in aluminum reduction cells.

U.S. Pat. No. 4,533,452 to Leroy et al discloses a floating screen which includes either floating balls or a single structure or a plurality of interlocking plates. The floating screen elements are made from $TiB_2$ coated porous structures which many have porous $TiB_2$ or graphite cores, or cores made from a mixture of materials. In use, the floating screen is positioned between the anode and cathode, at the interface of the liquid aluminum sheet and the layer of electrolyte and is not connected to the cathode.

U.S. Pat. No. 4,532,017 to Keinborg et al discloses floating cathode elements which are utilized in Hall-Heroult cells for the production of aluminum. The floating cathode elements are made from composites which include floating substrates, such as graphite and $TiB_2$ materials. The floating cathodes are secured by anchoring means.

The present invention in an improvement over prior art materials devices which are floatable on molten materials, particularly molten aluminum.

DISCLOSURE OF THE INVENTION

It is accordingly one object of the present invention to provide for materials which are floatable on molten aluminum and aluminum alloys and reactive aluminum alloys, including aluminum-lithium alloys.

It is another object of the present invention to provide for floatable multi-phase metal and ceramic articles which may be utilized in conjunction with aluminum processes including aluminum reduction, melting, transferring and casing.

It is a further object of the present invention to provide for floating refractory hard metal (RHM) cathode elements for use in aluminum reduction cells.

It is a still further object of the present invention to provide methods for reducing alumina in an aluminum reduction cell.

It is a still further object of the present invention to provide methods for melting, transferring and casting aluminum and aluminum alloys which utilize various floating articles.

Accordingly, the present invention provides for an electrolysis tank for producing aluminum by electrolysis of alumina dissolved in a bath of molten cryolite between at least one upper anode and a pool of molten aluminum covering a lower cathode substrate. The tank includes at the interface between the pool of molten aluminum and the bath of cryolite at least one floating cathode element positioned in a guide means which does not limit the upward vertical movement of the at least one floating cathode element.

The present invention further provides for a method of stabilizing and protecting the surface of molten aluminum which comprises floating substantially uniformly porous refractory hard metal articles on the surface of a molten aluminum pool.

BRIEF DESCRIPTION OF DRAWINGS

The present invention will be described with reference to the annexed drawings which are given by way of non-limiting examples only, in which.

BEST MODE FOR CARRYING OUT THE INVENTION

A variety of ceramic materials including refractories have properties, i.e. chemical inertness and high temperature stability, which are necessary in metal melting and casting processes. The density of most commercially available refractories and ceramic materials, which withstand the attack of aluminum and cryolite melts, is higher than that of molten aluminum, and therefore these denser materials will not float on the surface of molten aluminum.

According to one aspect of the present invention, it has been discovered that the density of a variety of ceramic materials and refractories may be appropriately adjusted and controlled during manufacture by varying the porosity of these materials. In this manner, the bulk densities of otherwise suitable ceramic materials and refractories may be lowered below the density of molten aluminum and aluminum alloys. These resulting materials which are buoyant on molten aluminum and aluminum alloys may be made in a variety of shapes for particular uses in the aluminum industry, as discussed below.

Molten aluminum (with a purity of 99.9%) has a density between 2.368 g/cm$^3$ at 660° C. and 2.304 g/cm$^3$ at 950° C. In order to be buoyant, the densities of the refractories and ceramic materials of the present invention must be appropriately lowered to below about 2.3 g/cm$^3$.

Initially, the materials utilized according to the present invention were selected on the basis of their thermal and chemical stability in molten aluminum and aluminum alloys. In instances wherein a selected material was found to have too high of a density so as to prevent the material from floating on molten aluminum, it has been found that the density of the final material article, that is the "shaped" article, may be controlled according to a number of methods.

Figure 1:
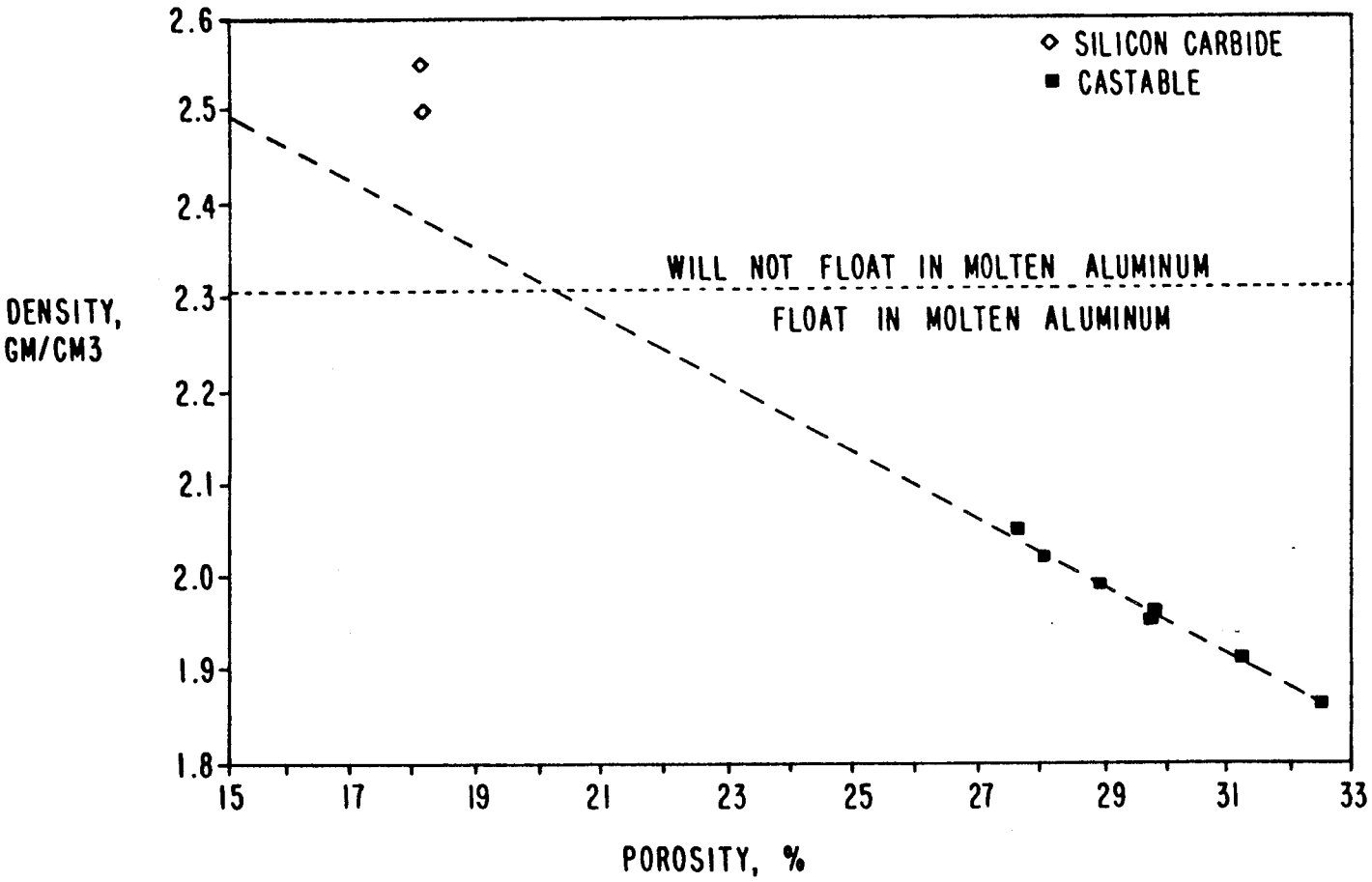
FIG. 1 is a graph illustrating the refractory density-porosity relationship for silicon carbide and castable refractory.

For example, it is possible to lower the density of an article shaped from a castable refractory material by increasing the porosity of the material during production of the cast article. Accordingly, it is possible to reduce the density of refractory shaped articles by either increasing the water content or decreasing the ram compaction of a castable refractory during the production of the shaped or cast article. In some instances, it may be desirable to both increase the water content and decrease the ram compaction in order to obtain a desired density. As an example of this method, the density of castable refractory was reduced according to the present invention from 2.60 g/cm$^3$ to below 2.30 g/cm$^3$ by uniformly increasing the porosity of the material. FIG. 1 illustrates the relationship between porosity and density for silicon carbide and castable refractory and further illustrates the density below which silicon carbide and castable refractory will float on molten aluminum.

Another way to decrease the density of a refractory material according to the present invention involves adhering a less dense material such as a graphite cement to the material to make it float on molten aluminum. This method, as well as the previously discussed method, has been utilized to reduce the density of silicon carbide from about 2.60 g/cm$^3$ to below 2.30 g/cm$^3$.

A few refractory materials investigated during the present invention have been discovered to have sufficiently low densities so that these materials either already float on molten aluminum or otherwise require a very small reduction in density utilizing the above-discussed methods. For example, colloidal silica-based refractories have densities of about 1.96 gm/cm$^3$. Floating refractories according to the present invention may be used with or without aluminum non-wetting agents to enhance their performance.

The shaped articles according to the present may be produced for a variety of applications in the aluminum industry. For example, in aluminum reduction cells, floating various shapes on the aluminum metal pad surface at the aluminum-cryolite interface in the inner-electrode gap between the carbon anode an the aluminum cathode may be utilized to reduce the cells' specific energy consumption by reducing the cells' operating voltage due to the damping of the aluminum metal surface waves. In this embodiment, the floatable shaped articles float like icebergs with the major portion or volume of the individual articles (about 90%) being actually below the surface of the aluminum metal. Floatable cylinders of refractory materials may be utilize in aluminum reduction cells to reduce the quantity of material required in the cells and to effectively reduce the aluminum metal flow due to electromagnetic interactions. Other shapes found to be useful in aluminum reduction cells for this purpose include spheres, plates, blocks, and the like.

Incorporating floatable refractory shapes in aluminum reduction cells may further provide for an increase of the cells, productivity or amperage efficiency due to the decrease in the transfer of the aluminum metal across the boundary interface into the cryolite bath where it is oxidized by anode gases due to the reduced metal velocities and reduced aluminum metal-cryolite surface area.

The shaped articles according to the present invention have been found to be utilized in cast house transfer troughs to reduce the oxidation at the surface of the molten aluminum and aluminum alloys during transfer of molten aluminum and aluminum alloys from holding furnaces to various casting operations or other stations. In this application, the shaped articles aid in reducing skim formation and the risk of oxide inclusions in solid metal downstream. Since the purpose of the floating article is to cover and protect the surface of the molten aluminum, any shape from plates, pads, screens, mats, etc., to spheres, cylinders and non-uniform shapes are useful.

In addition to protecting the surface of the molten aluminum and aluminum alloy, the use of the floatable shaped articles according to the present invention may reduce variations in hydrodynamic pressures (hence flow) through nozzles controlling the flow to casting molds.

In cast house furnaces, as well as recycling and reclamation furnaces, the floating shaped articles of the present invention may be utilized to reduce the oxidation and dross formation generated during the long holding periods required, without detrimentally affecting the heat transfer from the hot gases to the aluminum metal by reducing the area of contact with oxygen-containing gases. Moreover, the thermal adsorptivity of the floating shaped articles may be made higher than aluminum, thus increasing heat transfer to the metal pool. Suitable shapes for use in cast house furnaces include those mentioned above which may be used in transfer troughs, e.g., plates, pads, mats, screens, etc., or spheres, cylinders and non-uniform shapes.

In casting operations, floating the shaped articles of the present invention on the surface of molten aluminum and aluminum alloys during casting, e.g., d.c. casting and electromagnetic casting (EMC) may reduce the oxidation and dross formation of the aluminum and aluminum alloys during casting. Moreover, utilizing the floating articles in casting operations may reduce the formation of dross pockets on the surface of aluminum ingots, especially high magnesium 5000 series alloys, which cause surface defects such as ripples or creases that result in poor rolling quality and/or require scalping the metal surface prior to rolling operations.

Use of the floating articles according to the present invention has been found to be particularly advantageous in operations involving melting, transferring and casting of reactive aluminum alloys, especially aluminum-lithium alloys.

A list of suitable materials which may be utilized to produce floating articles for use in conjunction with molten aluminum and aluminum alloys is set forth below in Table I.

TABLE I

| Material | Theoretical Density, g/cm³ | Melting Point °C. |
|---|---|---|
| 1. Metals | | |
| Titanium | 4.5 | 1675 |
| Yttrium | 4.5 | 1509 |
| 2. Metal Borides | | |
| $VB_2$ | 5.1 | — |
| $TiB_2$ | 4.5 | — |
| 3. Metal Carbides | | |
| SiC | 3.2 | 2829 |
| TiC | 4.9 | 3067 |
| $B_4C$ | 2.5 | 2427 |
| 4. Metal Nitrides | | |
| VN | 6.1 | 2320 |
| CrN | 6.1 | 1500 |
| TiN | 5.2 | 2930 |
| $Si_3N_4$ | 2.6–3.4 | 2930 |
| Si—Al—ON | 2.6 | — |
| 5. Metal Oxides | | |
| MgO | 3.4 | 2825 |
| $TiO_2$ | 4.5 | 1460 |
| $Al_2O_3$ | 4.0 | 2015 |
| $ZrSiO_4$ (Zircon) | 4.6 | 2550 |
| $MgAl_2O_3$ (Spinel) | 3.6 | 1920 |
| $3Al_2O_3.2SiO_2$ (Mullite) | 3.2 | 1920 |
| $Al_2O_3.SiO_2$ (Sillimanite) | 3.2 | 1545 |
| $CeO_2$ | 7.12 | 2600 |
| $Le_2O_3$ | 6.5 | 2307 |
| $ZrO_2$ | 5.5 | 2764 |
| $HfO_2$ | 9.7 | 2844 |
| $La_2O_3$ | 6.6 | 2266 |
| CaO | 3.3 | 2614 |
| 6. Metal Silicides | | |
| $MoSiO_2$ | 6.3 | — |
| FeSi | 6.1 | — |
| $CrSi_2$ | 5.5 | — |

The materials listed in Table I are stable at the temperatures required for maintaining molten aluminum. Moreover, these materials are not appreciably soluble in molten aluminum.

According to the present invention, it has been determined that mixtures of these materials singly or in numerous oxide combinations in the form of ceramics and cermets having superior properties for purposes of the present invention. Oxides of the materials listed in Table I which have been found to be particularly useful for purposes of the present invention are listed in Table II below with the solubilities of these oxides in molten cryolite.

TABLE II

| Solubility of Oxide in Molten Cryolite | |
|---|---|
| Metal Oxide | Solubility wt. % |
| $TiO_2$ | 4.9–8.8 |
| $CeO_2$ | 3.4–16 |
| $Mn_3O_4$ | 2.1 |
| CuO | 1.1–1.2 |
| $V_2O_5$ | 0.9–1.2 |
| CdO | 1.5 |
| ZnO | 0.5–3 |
| $Ta_2O_5$ | 0.4 |
| NiO | 0.2–0.3 |
| $CO_3O_4$ | 0.2 |
| $Fe_2O_3$ | 0.14–1.1 |
| $Cr_2O_3$ | 0.12–0.18 |
| $SnO_2$ | 0.02–0.08 |

Of the various applications for which the refractory shape articles of the present invention may be utilized, the use of floating refractory hard metal (RHM) cathode elements in aluminum reduction cells is a particularly useful application. Accordingly, the present invention, in addition to providing for floatable refractory articles, further provides for a unique aluminum reduction cell having RHM floating cathode elements.

Figure 2:
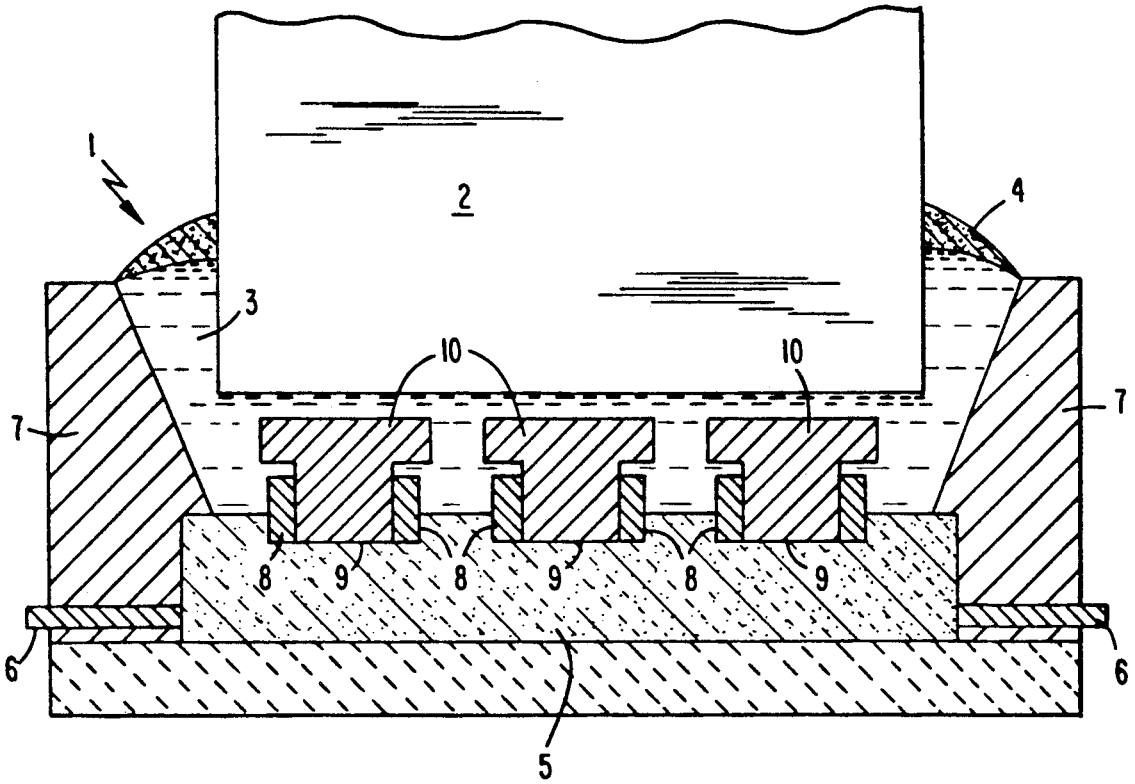
FIG. 2 is an end sectional view of an aluminum reduction cell, with the end wall removed, according to one embodiment of the present invention.

FIG. 2 illustrates an aluminum reduction cell or electrolysis tank 1 employing a floating cathode element according to the resent invention. Upper anode blocks 2, formed from a carbonaceous material, are suspended within a bath 3 of alumina dissolved in molten cryolite and are attached to a source of electrical current by means not shown. A crust 4 of frozen cryolite-alumina covers the bath 3. Carbonaceous cathode substrate blocks 5 may be formed by a rammed mixture of pitch and ground carbonaceous material by means of a carbonaceous cement, by means well-known to those skilled in the art. These cathode blocks 5 are connected by means of conductor bus bars 6 to the electrical current source to complete the electrical circuit. Outer walls 7 of the electrolysis tank form the side and end supporting structures for the tank 1. The walls 7 may be formed, for example, from graphite blocks held together with a graphite cement.

The carbonaceous cathode substrate blocks 5 include a plurality of guide means or sleeve members 8 which are fixedly mounted to the carbonaceous cathode, such as by cementing with a carbonaceous cement, or the like. The guide means or sleeve members 8 may be located on a flat surface of carbonaceous cathode substrate blocks 5, but as illustrated, are preferably located in recesses 9 in the carbonaceous cathode substrate blocks. The guide means or sleeve members have cross sectional shapes corresponding or complementary to that of the floating cathode elements 10. Each guide means or sleeve member has a height which is less than the metal pad 11 to prevent dissolution of the material forming the guide means or sleeve member. The guide means or sleeve members 8 may be formed of such materials as silicon nitride bonded silicon carbide, aluminum nitride, silicon nitride, silicon carbide, boron nitride, and the like.

When utilizing circular guide means or sleeve members, the inner diameter of the bore of the guide means or sleeve member 8 is slightly larger than the outer diameter of the corresponding floating cathode element 10. This size relationship between the guide means or sleeve members and the corresponding floating cathode elements applies whether or not these elements are circular, square, rectangular, or have any other cross-sectional shape. In this regard, the function of the guide means or sleeve members is to allow the floating cathodes to move freely in the vertical direction while restricting the horizontal or lateral movement of the floating cathode elements During operation, as aluminum metal is being produced, it is important that the guide means or sleeve members include one or more holes or slots on lower portions thereof, preferably adjacent the upper surface of the carbonaceous cathode substrate blocks 5, to allow the metal depth to equilibrate with the cell's bath height. Alternately, the guide can be inside the floating shape as a cap.

The floating cathodes, which may be of any desired lateral cross-sectional shape, are allowed to freely float up and down in the reductions cell's metal pad during routine cell operation. In this regard, the density of the floating cathode elements are selected or adjusted to ensure that the elements float on the top surface of the reduction cell's aluminum pad, i.e., at the interface 15 between the aluminum metal pad which has density of about 2.303 gm/cm$^3$ and the cryolite bath which has a density of about 2.150 gm/cm$^3$.

As discussed above, suitable materials for producing the floating cathode elements are selected from those which are both thermally stable and chemically stable in molten aluminum and cryolite. In addition, the floating cathode elements are required to be electrical conductive. Suitable materials which may be utilized alone or in combination may be selected from either Table I or II, with the materials of Table II being preferred. However, the densities of these materials must be adjusted to be between about 2.150 and 2.303 gm/cm so that the resulting cathode elements float at the interface between the aluminum pad and the cryolite bath in a reduction cell gm/cm$^3$.

It has been discovered that the density of the floating cathode elements, made from the materials listed in Tables I and II, can be adjusted in a number of manners. According to one method, lighter density materials, such as carbon, may be added to the selected RHM composition during manufacturing to decrease the final cathode element density to the desired density necessary to float on molten aluminum.

In another method, the floating cathodes may be made by applying a coating or layer of a selected RHM material to the underside of a floating element having the proper density required to float on the aluminum pad.

In a further embodiment, a solid, less dense material, e.g., carbon, may be attached to a floating cathode element made from a material selected from Tables I and II so that the overall density of the assembly is sufficient to float the cathode electrode on the surface of the aluminum metal pad.

Figure 3:
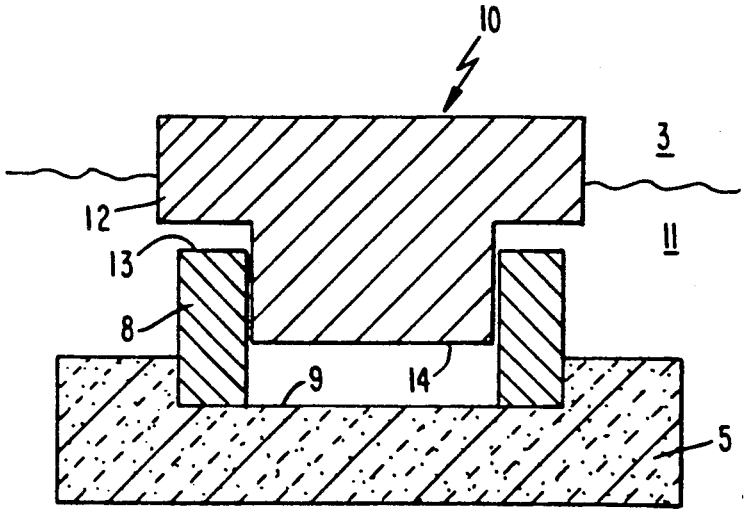
FIG. 3 is an exploded cross-sectional view of one of the floating RHM cathodes of the present invention.

The floating cathode element 10 as best illustrated in FIG. 3 may have a "T" shaped upper portion or flange 12 which is designed to rest on the upper surfaces 13 of the corresponding guide means or sleeve members 8. In further embodiments illustrated in FIGS. 4 and 5, the floating cathode element 10 does not include an upper "T" portion, and is free to move vertically within the corresponding guide means or sleeve member 8.

Figure 4:
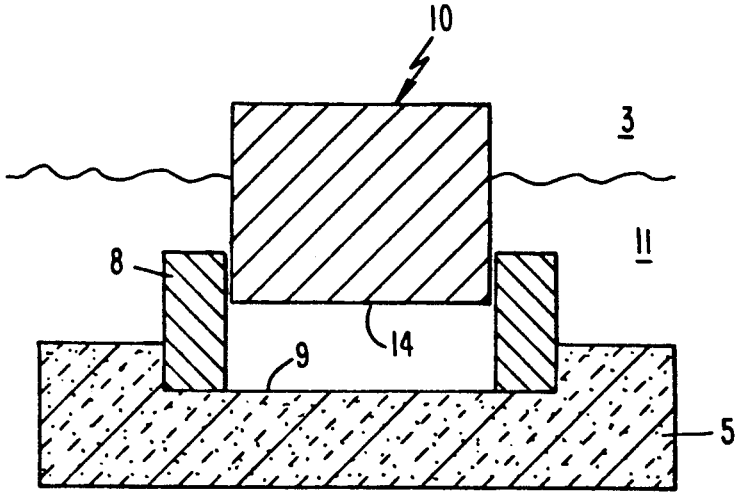
FIGS. 4 and 5 are exploded cross-sectional views of alternate embodiments of floating RHM cathodes according to the present invention.
Figure 5:
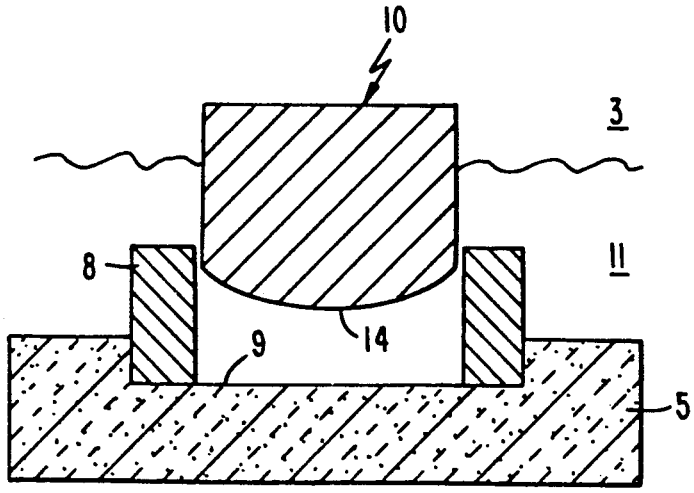

The lower surface 14 of the floating cathode elements may be either flat or convex or curved, e.g., spherically shaped as illustrated in FIGS. 3–5.

Although the invention has been described with reference to particular means, materials and embodiments, from the foregoing description, one skilled in the art can easily ascertain the essential characteristics of the present invention and various changes and modifications may be made to adapt the various uses and conditions without departing from the spirit and scope of the present invention as described by the claims which follow.

We claim:

1. An electrolysis tank for producing aluminum by electrolysis of alumina dissolved in a bath of molten cryolite between at least one upper anode and a pool of molten aluminum covering a lower carbonaceous cathode substrate, said tank including at the interface between the pool of molten aluminum and the bath of molten cryolite at least one cathode element adapted for flotation, said at least one cathode element having a density less than that of the molten aluminum and greater than that of the molten cryolite such that said at least one cathode element is enabled to float on the surface of the molten aluminum pool, said at least one cathode element being positioned in a guide means which does not limit the free and responsive upward vertical movement of said at least one cathode element but does limit the lateral motion of said at least one cathode element, said guide means comprising a sleeve member which is fixedly attached to said lower carbonaceous cathode substrate in a recess formed in said lower carbonaceous cathode substrate and includes a bore which is complementarily shaped to said at least one cathode element for receiving said at least one cathode element in said bore in a freely sliding manner.

2. An electrolysis tank according to claim 1, wherein said guide means is made from a material selected from the group consisting of silicon carbide, silicon nitride, aluminum nitride and boron nitride, and composites thereof.

3. An electrolysis tank according to claim 1, wherein said sleeve member includes at least one opening therein to permit molten aluminum to flow freely in said tank.

4. An electrolysis tank according to claim 1, wherein said sleeve member has a height which is below said interface.

5. An electrolysis tank according to claim 1, wherein said at least one cathode element includes an upper flange portion for contacting said guide means in a lower most position.

6. An electrolysis tank according to claim 1, wherein said at least one cathode element has a flat lower surface.

7. An electrolysis tank according to claim 1, wherein said at least one cathode element has a convex lower surface.

8. An electrolysis tank for producing aluminum by electrolysis of alumina dissolved in a bath of molten cryolite between at least one upper anode and a pool of molten aluminum covering a lower carbanaceous cathode substrate, said tank including at the interface between the pool of molten aluminum and the bath of molten cryolite at least one cathode element adapted for flotation and positioned in a guide means which does not limit the free and responsive upward vertical movement of said at least one cathode element, wherein said at least one cathode element is made from a refractory hard metal comprising titanium diboride combined with at least one ceramic material and has a density between about 2.150 gm/cm$^3$ and about 2.303 gm/cm$^3$, said density being less than that of the molten aluminum and greater than that of the molten cryolite such that said at least one cathode element is adapted for flotation on the surface of the molten aluminum pool.

9. An electrolysis tank according to claim 8 wherein said at least one cathode element is porous.

10. An electrolysis tank for producing aluminum by electrolysis of alumina dissolved in a bath of molten cryolite between at least one upper anode and a pool of molten aluminum covering a lower carbonaceous cathode substrate, said tank including at the interface between the pool of molten aluminum and the bath of molten cryolite at least one cathode element adapted for flotation and positioned in a guide means which does not limit the free and responsive upward vertical movement of said at least one floating cathode element, wherein said at least one cathode element comprises a refractory hard metal structure in combination with a less dense structure which is both thermally and chemically stable in molten cryolite and wherein said at least one cathode element has a density between about 2.150 gm/cm$^3$ and about 2.303 gm/cm$^3$, said density being less than that of the molten aluminum and greater than that of the molten cryolite such that said at least one cathode element is adapted for flotation on the surface of the molten aluminum pool.

11. A method of stabilizing and protecting the surface of molten aluminum beneath a molten cryolite bath which comprises floating substantially uniformly porous refractory hard metal articles on the surface of a molten aluminum pool wherein the density of said substantially uniformly porous refractory hard metal articles is controlled by casting said refractory hard metal articles according to a process wherein one or both of the water content in the castable refractory hard metal and/or the casting compaction pressure is adjusted so as to produce a density which is less than the density of the molten aluminum and greater than the density of the molten cryolite such that said at least one floating cathode element floats on the surface of the molten aluminum.

12. A method of stabilizing and protecting the surface of molten aluminum according to claim 11, wherein said refractory hard metals are selected from the group consisting of metal borides, metal carbides, metal nitrides, metal oxides, metal silicides, and mixtures thereof which are thermally and chemically stable in molten aluminum.

13. A method of stabilizing and protecting the surface of molten aluminum according to claim 11, wherein said refractory hard metal articles are sufficiently porous to float on molten aluminum.

* * * * *